United States Patent [19]

Sing

[11] Patent Number: 4,720,408

[45] Date of Patent: Jan. 19, 1988

[54] DESTRUCTIBLE CARBON PAPER

[76] Inventor: Peter Sing, 43 Donnybrook Rd., Scarsdale, N.Y. 10583

[21] Appl. No.: 31,376

[22] Filed: Mar. 30, 1987

Related U.S. Application Data

[63] Continuation-in-part of Ser. No. 906,897, Sep. 15, 1986, abandoned.

[51] Int. Cl.[4] ..... B65D 65/28; B41L 1/16

[52] U.S. Cl. ..... 428/43; 282/28 A; 282/28 R; 283/103; 428/105; 428/109; 428/131; 428/137; 428/192; 428/292; 428/294; 428/537.5

[58] Field of Search ..... 282/28 R, 28 A; 283/103; 428/43, 105, 109, 292, 294, 192, 131, 137, 537

[56] References Cited

U.S. PATENT DOCUMENTS 3,716,132 2/1973 Lewyckyj ..... 428/43

4,150,184 4/1979 Tesch ..... 428/43

*Primary Examiner*—James J. Bell

*Attorney, Agent, or Firm*—Nathaniel Altman

[57] ABSTRACT

Carbon paper duplicating sheets, such as those used in credit-card transaction forms, are made easily destroyable after authorized use without hand-soiling by incorporating, into the tissue paper base of the carbon paper sheets, filament strands arranged in repetitively alternating angular relationship to the edges of, and throughout, the carbon paper sheets. Duplicating-ink-free areas are provided at opposite edges of each sheet so that it may be grasped between the thumb and fingers of each hand to render the used carbon paper shredded, uncopyable and therefore safely disposable. The addition of perforations in the paper base in selected areas may be made to enhance the easy destructibility of the duplicating sheets.

9 Claims, 6 Drawing Figures

DESTRUCTIBLE CARBON PAPER

This application is a cip of Ser. No. 06/906,897 filed 09/15/86 abandoned.

FIELD OF THE INVENTION

This invention relates to the clean and safe disposal of used carbon paper, and more particularly to the rendering of carbon paper involved in a credit-card transaction unusable for unauthorized copying.

BACKGROUND OF THE INVENTION

The almost universal use of credit cards has introduced the problem of safe disposal or destruction of the carbon paper sheet(s) sandwiched between copies of the credit-card transaction forms. These carbon paper sheets, after the forms have been filled out, carry the impression of the credit card indicia and the card owner's signature, and are subject to unauthorized copying and criminal abuse in unfriendly hands. It is therefore the practice in most restaurants and stores to present the credit card holder with the carbon paper sheet(s) along with the customer copy of the transaction form. Now the cardholder is confronted with the unhappy choice of either destroying the carbon paper at once by tearing it up, thus smearing his hands with carbon duplicating ink, or of storing the carbons for future disposition in pocket, wallet or purse, which merely delays and increases the likelihood of carbon ink's unwelcome spreading on fingers, pocket linings and the like.

SUMMARY OF THE INVENTION

It is a principal object of this invention to provide the means for effectively putting used carbon paper into uncopyable condition promptly, easily and without soiling or smearing. This is accomplished by incorporating fine filament strands throughout the paper during its manufacture arranged in such a way that when the carbon paper is firmly pulled at opposite edges simultaneously, the filament strands tierally pullapart and shred thr carbon paper into tattered pieces unusable for copying. Since the carbon papers are each provided with appropriate ink-free gripping areas, it is a simple matter to grasp each paper at these points between the thumb and fingers of each hand and pull the hands apart; the filaments, distributed through and positioned in the paper in a repetitive alternating pattern angularly with respect to the direction of the pulling force, create an angular tearing component of force which rips and shreds the paper at each place where a filament strand is located.

Small perforations in the paper, especially in the areas of the forms where signatures and identifying numbers will be registered, may be added to assist and to ensure complete shredding of the paper and destruction of the critical indicia.

Illustrative examples of the practice of this invention will now be described in full detail in connection with the accompanying drawings, wherein:

SHORT FIGURE DESCRIPTION OF THE DRAWINGS

DESCRIPTION OF THE PREFERRED EMBODIMENTS

Figure 1:
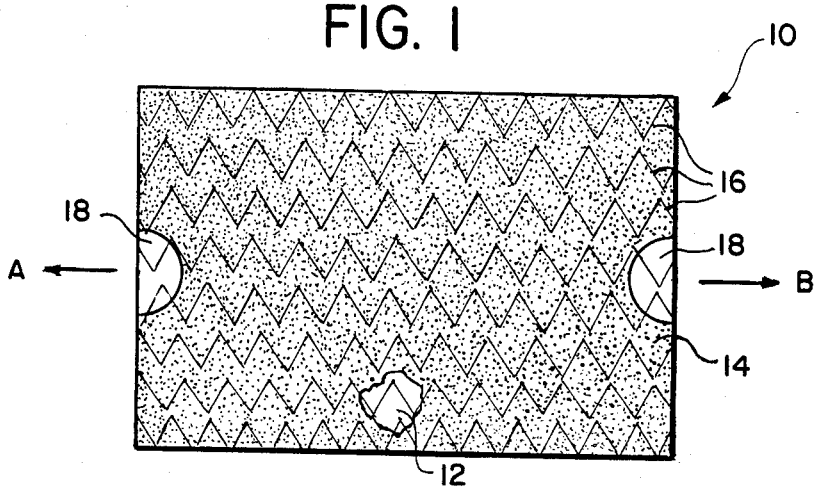
FIG. 1 is a schematic plan view of a preferred embodiment of a duplicating carbon paper sheet in accordance with this invention.

FIG. 1 illustrates a carbon paper insert sheet generally designated 10, comprising tissue paper base 12 coated with ink-transfer duplicating layer 14 in the conventional manner of prior art carbon paper. Incorporated in, and distributed throughout, paper base 12 are filament strands 16, arranged in a repeating pattern of zig-zag threads so that virtually throughout their entire length the filaments are disposed in alternating repetitive angularity with respect to the edges of paper base 12. Fingergripping areas 18,18 at either end of paper 12 are free of ink-transfer layer 14 whereby sheet 10 may be grasped between thumb and fingers of both hands wtihout soiling the hands. Firm pulling in opposite directions A,B puts an angular tearing stress on paper base 12, which gives way and rips in the areas wherein filaments 16 are embedded. A shredded uncopyable carbon paper sheet results, which may now be safely discarded, and with after-cleaning of the fingers unnecessary.

It is evident that filaments 16 must be thin enough to be incorporated in paper base 12 without causing roughness or bumpiness in the paper and without adversely affecting its duplicating efficiency. The strands or threads of filaments 16 may be of either natural or synthetic composition, and obviously must have sufficient tensile strength for paper base 12 to tear before they do.

Figure 2:
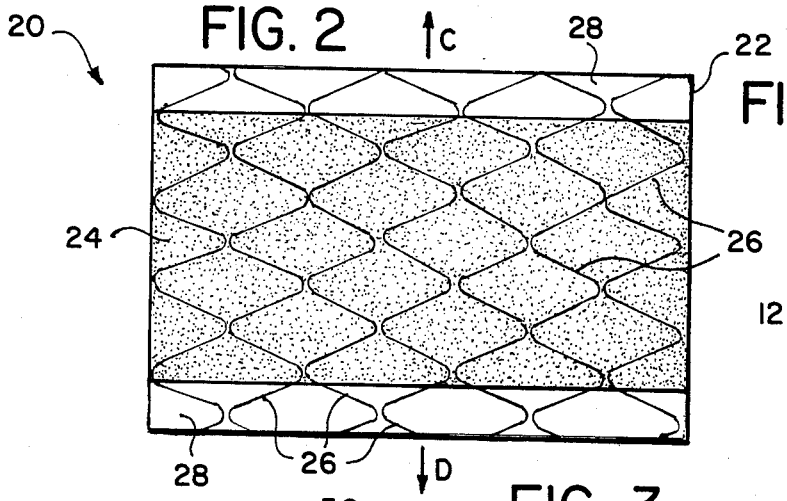
FIG. 2 is a view similar to FIG. 1 of another preferred embodiment.

The embodiment shown in FIG. 2 comprises carbon paper sheet 20, with paper base 22 generally coated with ink-transfer duplicating layer 24, and incorporating filaments 26. Top and bottom edges of sheet 20 are left uncoated at 28,28 to allow for clean stain-free handling when sheet 20 is pulled in opposing directions C,D for rendering it uncopyable. Filaments 26 are herein arranged throughout the body of paper base 22 in a recurrent sinusoidal wave pattern in alternating angular relationship to pulling directions C,D.

Figure 3:
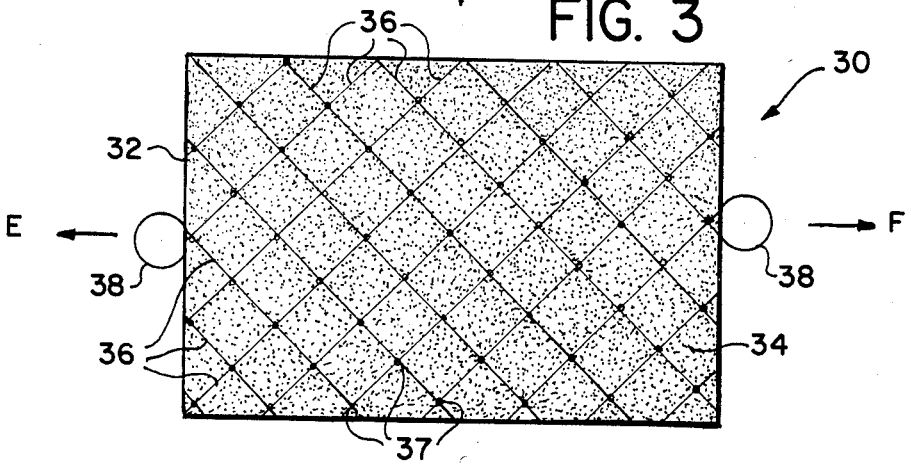
FIG. 3 is a view similar to FIG. 1 of still another preferred embodiment.

FIG. 3's carbon paper 30 comprises tissue paper base sheet 32 covered throughout with duplicating ink layer 34. Here the filaments 36 are spread throughout paper 32 in the form of a mesh network, the angularly disposed strands of which are attached to each other at each crossing point 37. The network is positioned angularly with respect to the edges of sheet 30. Extensions 38,38 which are shown in the form of filament loops but which alternatively may be paper tabs, are free of ink and serve as finger grips for pulling sheet 30 in opposing directions E,F and thus destroying its copyability.

Figure 4:
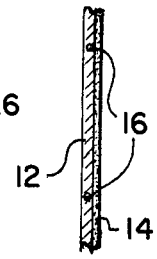
FIG. 4 is an enlarged fragmentary sectional view through a typical carbon paper of this invention.

FIG. 4 is typically descriptive of all three embodiments heretofore outlined, but for convenience has been assigned the reference characters of FIG. 1. As shown, filaments 16 are embedded in paper base 12, with duplicating ink layer 14 coating one side (the downward side when the credit card is impressed against the credit card transaction form).

Figure 5:
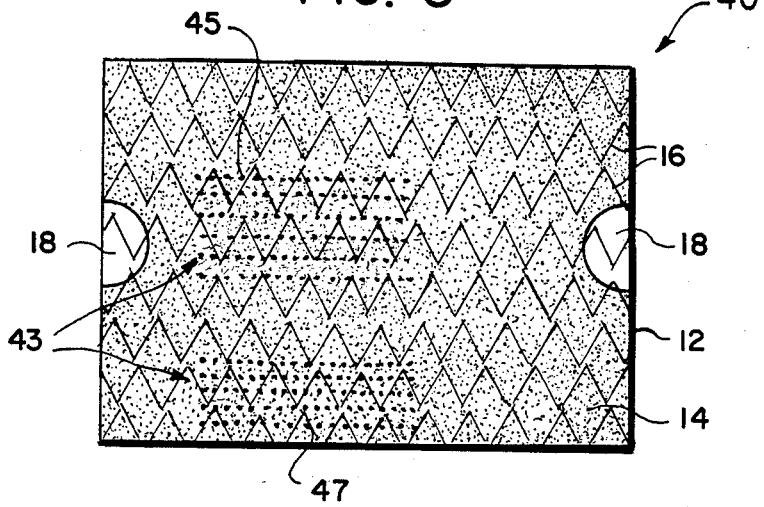
FIG. 5 is a schematic plan view of another preferred carbon paper embodiment.

In FIG. 5, carbon paper 40 has all the elements of carbon paper sheet 10 of FIG. 1, but with added perforations 43 in areas 45,47 to ensure more complete destruction at these locations, where credit card indicia and a user's signature respectively would appear when the credit card transaction form has been used.

Figure 6:
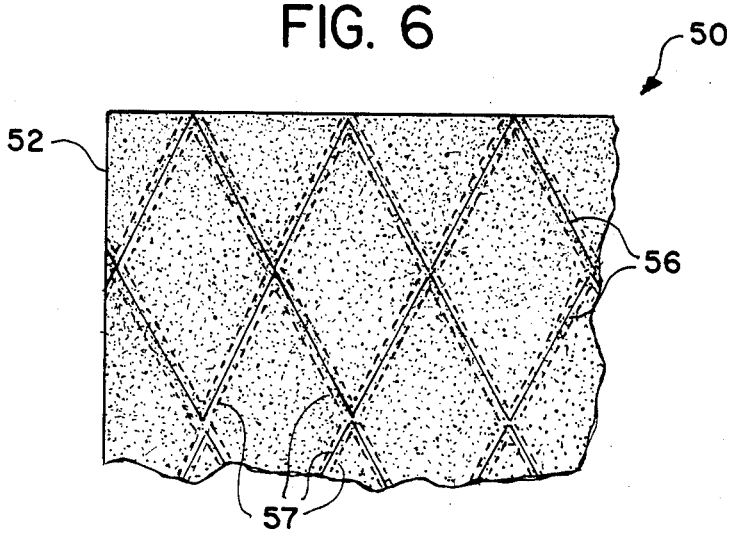
FIG. 6 is a schematic fragmentary view of still another preferred embodiment.

FIG. 6 shows an alternate arrangement of filaments and perforations, in which carbon sheet 50 has angularly disposed filaments 56 followed and flanked by rows of perforations 57 to increase the shreadability of paper base 52.

Several illustrative embodiments for practising this invention have been described; possible substitutions and modifications will be apparent to those skilled in the art within the spirit and concepts of this invention, which is defined and limited only by the scope of the appended claims.

What is claimed is:

1. Destructible carbon paper duplicating sheet to be used for making authorized copies and thereafter to be rendered uncopyable by being pulled apart manually without soiling the hands of the puller, which comprise:

a tissue paper base sheet;

a plurality of filament strands embedded in and distributed throughout said paper base sheet, said filament strands being arranged in a repetitive pattern of alternating angular relationship to the edges of said paper sheet;

duplicating ink transfer layer substantially coating one surface of said paper sheet; and oppositely disposed means for gripping the destructible carbon paper sheet with the thumb and fingers of both hands, said gripping means being devoid of said ink transfer layer so that hands are unsoiled when the carbon paper sheet is pulled apart to be rendered unusable.

2. Destructible carbon paper sheet as defined in claim 1, wherein said plurality of filament strands are positioned uniformly throughout said paper base sheet in a repetitively zig-zag pattern.

3. Destructible carbon paper sheet as defined in claim 1, wherein said plurality of filament strands are positioned uniformly throughout said paper base sheet in a repetitively sinusoidal wave pattern.

4. Destructible carbon paper sheet as defined in claim 1, wherein said plurality of filament strands are positioned uniformly throughout said paper base sheet in a repetitively criss-crossing mesh pattern, said filament strands being attached to each other at each crossing.

5. Destructible carbon paper sheet in accordance with claim 1, wherein said means for gripping the carbon paper sheet is a pair of thumb-and-finger accommodating areas free of ink and positioned at opposite edges of said paper base sheet.

6. Destructible carbon paper sheet in accordance with claim 1, wherein said means for gripping the carbon paper sheet is a pair of thumb-and-finger-accommodating projections extending outwardly from opposite edges of said paper base sheet.

7. Destructible carbon paper sheet in accordance with claim 1, further comprising said paper base sheet being selectively perforated.

8. Destructible carbon paper sheet as defined in claim 7, wherein said perforations are located in areas of the carbon paper sheet which will receive the impression of a user's signature and identifying indicia.

9. Destructible carbon paper sheet as defined in claim 7, wherein said perforations flank and follow at least some of said filaments embedded in said paper base sheet.

* * * * *